United States Patent [19]

Kreinin et al.

[11] Patent Number: 4,467,779

[45] Date of Patent: Aug. 28, 1984

[54] RADIATION TUBE

[75] Inventors: Efim V. Kreinin, Moscow; Anatoly N. Smolkov; Valentin A. Iliin, both of Gorky, all of U.S.S.R.; Vladimir T. Golykh, deceased, late of Moscow, U.S.S.R., by Natta T. Ladygina, administrator

[73] Assignee: Vsesojuzny Nauchnoissledovatelsky Institut Ispolzovania Gaza V Narodnom Khozyaistve, U.S.S.R.

[21] Appl. No.: 418,221

[22] Filed: Sep. 15, 1982

[51] Int. Cl.[3] ..... F24C 3/00

[52] U.S. Cl. ..... 126/91 A; 432/209; 431/351

[58] Field of Search ..... 126/91 R, 91 A; 431/353, 351; 432/209

[56] References Cited

U.S. PATENT DOCUMENTS 4,062,343 12/1977 Spielman ..... 431/353

*Primary Examiner*—Carroll B. Dority, Jr.

*Attorney, Agent, or Firm*—Steinberg & Raskin

[57] ABSTRACT

A radiation tube with a multibranch heat-radiating housing, one of the branches accommodating a burner comprised of a cylindrical air supply shell having inlet and outlet portions, the shell being disposed axially relative to the heat radiating housing so as to form an annular passageway, the passageway having a cross-splate provided with one central and a plurality of circumferential apertures for the passage of air therethrough. The burner is further provided with an annular gas header defined by the inlet portion of said air supply shell and a partition wall interposed between the air supply shell and the heat-radiating housing, said partition wall having openings for uniform distribution of gas flow.

4 Claims, 3 Drawing Figures

RADIATION TUBE

FIELD OF THE INVENTION

The present invention relates to gas heating of furnaces intended for thermochemical treatment of workpieces in the metallurgical and machine building industries, and more particularly to radiation tubes.

The invention can be employed in conjunction with straight, as well as with V- and W-shaped radiation tubes.

PRIOR ART

There is known a V-shaped radiation tube comprising in the burner section or branch thereof an air supply shell adjacent to an apertured air distribution chamber. A gas feeding pipe is inserted into an annular passageway between the central air supply shell and the heat-radiating housing of the radiation tube. The V-shaped radiation tubes having such burners are manufactured by the Hallcroft Company, USA (cf., e.g., Kreinin E. V. "Sovremennye gasovye radiatsionnye truby metallurgicheskikh pechei—Modern Gas Radiation Tubes of Metallurgical Furnaces" Moscow, 1979, p. 7, FIG. 3a).

An inherent disadvantage of such radiation tubes resides in that gas is supplied to the burner from one side thereof, which results in that the primary gas-air mixture formed in the annular passageway is non-uniform in its composition. Flashbacks at certain operating conditions and stabilized combustion in the divergent portion of the air supply shell lead to localized overheating of the latter, thermal decomposition of the natural gas in the annular passageway accompanied by the deposition of soot thereonto and the narrower range of capacity and non-uniform heat distribution alons the length of the heat-radiating housing.

Also known is a V-shaped radiation tube the burner of which is provided with a partition disposed between the central air supply shell of diverging cylindrical configuration and the heat-radiating housing, the rear crossplate of the burner having one central and a plurality of circumferential apertures for separating the air into primary and secondary flows (cf., e.g., USSR Inventor's Certificate No. 623,058, Cl. F 23 d 13/12, published 1978).

This radiation tube construction is disadvantageous in that soot tends to appear in the passageway between the air supply shell and the heat-radiating housing due to flashbacks at the edges of the crossplates and a subsequent increase in the temperature of the primary gas-air mixture to the point when thermal decomposition of natural gas begins.

SUMMARY OF THE INVENTION

It is an object of the invention to provide a construction of the radiation tube which would completely prevent the deposition of soot therein.

Another object of the invention is to expand the range of control over the capacity of the radiation tube.

Yet another object of the invention is to provide uniform heating of the heat-radiating housing along the length of the radiation tube.

The objects are attained by that in a radiation tube with a multibranch heat-radiating housing one branch of which accommodates a gas burner comprised of a cylindrical air supply shell having inlet and outlet portions and arranged axially relative to the heat-radiating housing to form a passageway therebetween, the passageway having at the inlet portion thereof a crossplate provided with one central and a plurality of circumferential apertures for the passage of air therethrough, and a gas header having an outlet nozzle, according to the invention, the gas header of the burner is of annular shape and defined by the inlet portion of the air supply shell and a partition wall arranged between the air supply shell and the heat-radiating housing, the partition wall having openings to ensure uniform distribution of the gas flow.

Preferably, an orifice plate is arranged in the annular passageway defined by the outlet portion of the air supply shell and the heat-radiating housing, whereas the ratio between the outer diameter of the outlet portion of the air supply shell and the inner diameter of the heat-radiating housing is preferably within the range of from 0.8 to 0.95.

It is further preferable that there be provided a tubular element arranged axially relative to the inlet portion of the air supply shell for longitudinal displacement therein, the tubular element having a conical head piece secured to the front end thereof.

This construction of the burner of the radiation tube according to the invention prevents the flame from flashing back inside the annular passageway between the air supply shell and heat-radiating housing, provides uniform composition of the primary gas-air mixture and uniform distribution of the mixture on the perimeter of the annular passageway.

The foregoing ensures reliable operation of the radiation tube and uniform heating of the heat-radiating housing along the length of the radiation tube and affords control within a wide range of capacity.

BRIEF DESCRIPTION OF THE DRAWINGS

The invention will now be described in greater detail with reference to specific embodiments thereof taken in conjunction with the accompanying drawings, in which.

DETAILED DESCRIPTION OF THE INVENTION

Figure 1:
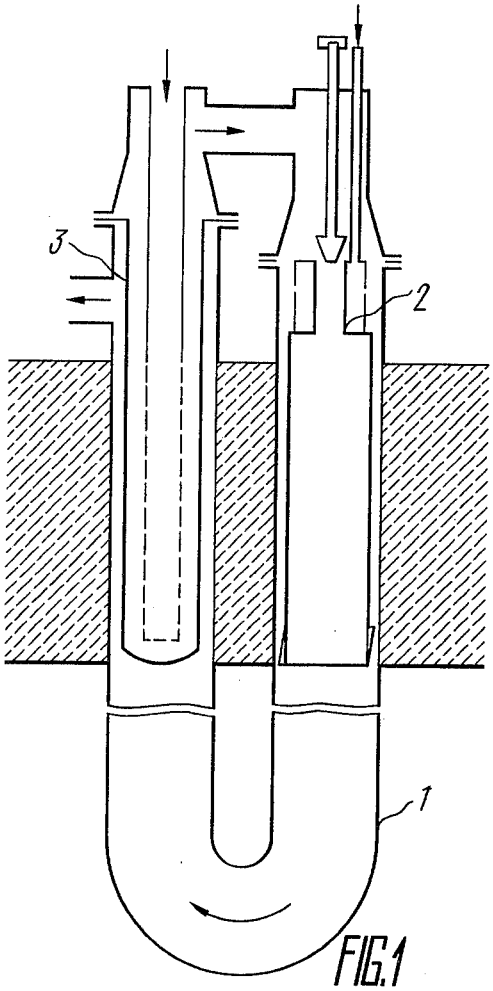
FIG. 1 is a schematic representation of a V-shaped radiation tube according to the invention.

With reference to FIG. 1, there is shown an exemplary embodiment of a V-shaped radiation tube (alternatively it may be W- or otherwise-shaped) according to the invention comprising a heat-radiating housing 1 one branch of which accommodates a burner 2, the other branch accommodating a high-efficiency heat recovery unit or recuperator 3.

Figure 2:
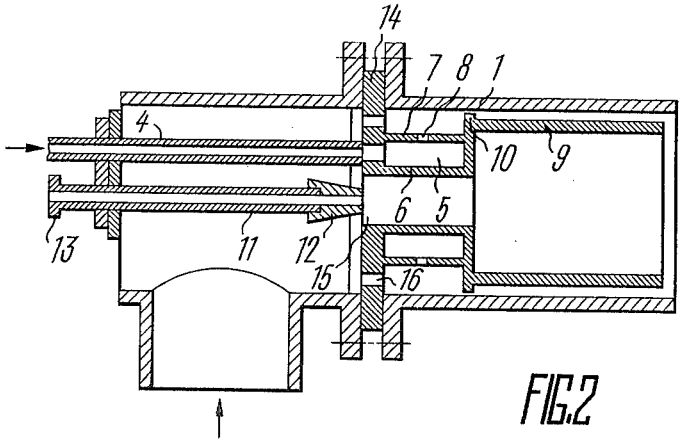
FIG. 2 shows a burner of the radiation tube according to the invention.

Referring now to FIG. 2, the burner 2 is comprised of a gas supply pipe 4, an annular gas header 5 defined by inlet portion 6 of an air supply shell, and a partiation wall 7 provided with openings 8 to ensure uniform distribution of the gas flow.

Interposed between the heat-radiating housing 1 and an outlet portion 9 of the air supply shell is an orifice plate 10. Disposed axially relative to the inlet portion 6 of the air supply shell is a movable tubular element 11, one end thereof having a conical headpiece 12, the other end having an inspection hole 13.

Positioned essentially to adjoin the inlet portion 6 of the air supply shell is a crossplate 14 provided with a central 15 and circumferential 16 apertures for the passage of air therethrough.

The radiation tube operates in the following manner. Cool outside air is fed to the high-efficiency recuperator 3, wherein it is heated to a temperature of between 300° and 400° C. to be thereafter conveyed to the gas burner 2 (FIG. 1).

The incoming air is divided in the burner 2 (FIG. 2) into two flows, one flow entering the central aperture 15 defined by the inlet portion 6 of the air supply shell, another flow passing through the circumferential apertures 16.

Gas is supplied to the burner 2 along the pipe 4 to enter the annular header 5, wherefrom it is caused to uniformly flow via the openings 8 into a cavity defined by the partition wall 7 and the heat-radiating housing 1. The primary air is caused to mix in this cavity with the gas, whereafter the thus formed gas-air mixture is conveyed to an annular passageway between the outlet portion 9 of the air supply shell and the heat-radiating housing 1.

The orifice plate 10 acts to prevent flashback between the inlet and outlet portions 6 and 9 of the air supply shell.

Mixing the primary gas-air mixture with a secondary air flow and the formation of a flat tongue of flame is effected at the open end of the outlet portion 9 of the air supply shell, the flame tending to extend along the inner surface of the radiating housing 1.

The products of combustion, after the passage through the recuperator 3 and having been cooled by from 400° to 600° C., are discharged from the radiation tube.

By virture of the speed of movement of the primary gas-air mixture at the outlet portion 9 of the air supply shell essentially exceeding the flame propagation velocity, flashbacks of the flame are prevented. The orifice plate 10 is also intended to prevent flashback.

In order to determine the optimum ratio between the outside diameter of the outlet portion 9 of the air supply shell and that of the inner wall of the heat radiating housing 1($d_b/d_k$), a test trial was conducted on a V-shaped radiation tube of 152 mm in diameter ($d_k$=132 mm) with the gas flow rate of 1 $m^3$/hr. The results of the tests are represented in the following table.

| Test No. | $d_b/d_k$ | Passageway resistance, in mm, $H_2O$ | Flashback | Notes |
|---|---|---|---|---|
| 1. | 0.8 | 3 | yes | traces of soot on the air-supply shell |
| 2. | 0.86 | 4 | no | no traces of soot |
| 3. | 0.9 | 6 | no | no traces of soot |
| 4. | 0.92 | 10 | no | no traces of soot |
| 5. | 0.95 | 15 | no | no traces of soot |
| 6. | 0.97 | 32 | no | no traces of soot, but combustion starts with the flame tending to break loose from the shell |

According to the table, at $d_b/d_k \leqq 0.8$ the frame tends to flash back against the flow of the mixture with traces of soot in evidence. No flashback or soot deposition occur at $d_b/d_k > 0.95$, although the flame is broken some 350–450 mm away from the end of the air supply shell. Therefore, the optimum ratio is $0.8 < d_b/d_k \leqq 0.95$.

Figure 3:
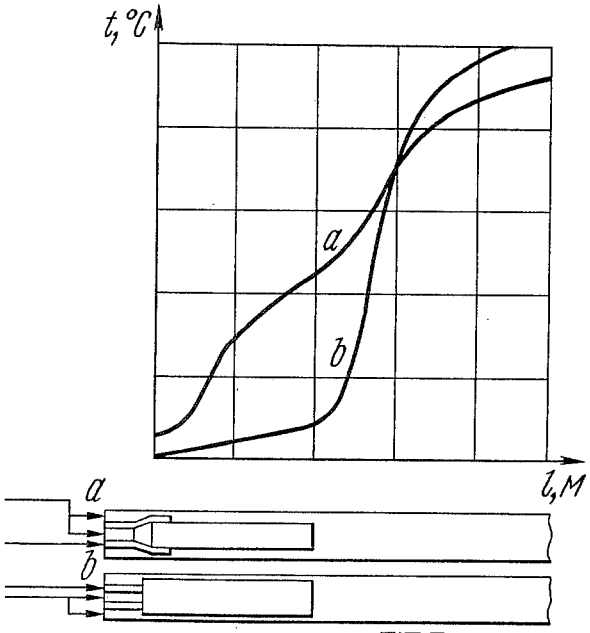
FIG. 3 are graphs illustrating operation of the radiation tube according to the invention.

Represented in FIG. 3 is a graph showing test-found temperature distribution in the heat radiating housing 1 along the length of the outlet portion 9 of the air supply shell.

In the prior art radiation tubes (cf., e.g., USSR Inventor's Certificate No. 623,058) the housing is heated (curve "a") due to the reaction of the primary gas-air mixture, which in turn may result in the deposition of soot. Conversely, in the radiation tube according to the present invention the gas-air mixture is practically not heated (curve "b"), which prevents the deposition of soot.

The tubular element 11 provided with the conical headpiece 12 serves to adjust the ratio between the amounts of primary and secondary air in the burner 2 (FIG. 2). By moving this tubular element 11 towards the central aperture 15 the passageway area for the secondary air is reduced, whereby the amount of the primary air is increased.

The provision of the tubular element 11 is especially advantageous for adjusting the combustion process in the radiation tube.

Having in view the foregoing, the radiation tube according to the invention makes it possible to prevent soot deposition, ensure uniform heating of the heat-radiating housing by the provision of flat flame in the burner section or branch thereof, as well as enables to operate in a wide range of gas feed control (1:15) at optimum air flow rates (the air feed rate factor in the radiation tube according to the invention is $\alpha = 1.03 \div 1.1$.)

What is claimed is:

1. A radiation tube with a multibranch heat-radiating housing having a gas burner disposed therein, the burner comprising a cylindrical air supply shell having inlet and outlet portions, the shell being arranged axially relative to said heat radiating housing so as to form an annular passageway;

a crossplate arranged at the inlet of said annular passageway, the crossplate having one central and a plurality of circumferential apertures for the passage of air therethrough;

a partition wall interposed between said air supply shell and said heat-radiating housing, said partition wall having a plurality of openings to ensure a uniform distribution of gas therethrough;

an annular gas header defined by said inlet portion of said air supply shell and said partition wall interposed between said air supply shell and said heat-radiating housing.

2. A radiation tube of claim 1, wherein an orifice plate is arranged in said annular passageway defined by said outlet portion of said air supply shell and said heat-radiating housing.

3. A radiation tube of claim 1, wherein in said annular passageway the ratio between the outer diameter of said outlet portion of said air supply shell and the inner diameter of said heat radiating housing ranges from 0.8 to 0.95.

4. A radiation tube of claim 1, wherein there is provided a tubular element (11) arranged axially relative to said inlet portion of said air supply shell for longitudinal displacement therein, said tubular element having a conical headpiece secured to the front end thereof.

* * * * *